US005925220A

United States Patent [19]

Hirsch et al.

[11] Patent Number: 5,925,220

[45] Date of Patent: Jul. 20, 1999

[54] SUCTION ROLL OF A PAPER MACHINE HAVING A NOISE DAMPING CHAMBER

[75] Inventors: Adalbert Hirsch, Aalen; Hans Prinzing, Heidenheim, both of Germany

[73] Assignee: Voith Sulzer Papiermaschinen GmbH, Germany

[21] Appl. No.: 08/641,987

[22] Filed: Apr. 19, 1996

[30] Foreign Application Priority Data

Apr. 19, 1995 [DE] Germany ..... 295 06 620

[51] Int. Cl.[6] ..... D21F 1/48; D21F 1/50; D21F 3/10

[52] U.S. Cl. ..... 162/368; 162/370; 162/371; 417/4; 417/5

[58] Field of Search ..... 162/368, 369, 162/258, 252, 370, 371, 372; 137/211, 209, 211.5; 417/5, 4; 492/20

[56] References Cited

U.S. PATENT DOCUMENTS

| | | | |
|---|---|---|---|
| 2,857,823 | 10/1958 | Thiessen | 92/53 |
| 3,981,319 | 9/1976 | Holt | 137/211 |
| 4,224,104 | 9/1980 | Kankaanpaa | 162/290 |
| 4,564,418 | 1/1986 | Blumle | 162/368 |
| 4,714,523 | 12/1987 | Sawyer, Jr. et al. | 162/371 |
| 5,466,343 | 11/1995 | Kankaanpaa | 162/357 |

FOREIGN PATENT DOCUMENTS

| | | |
|---|---|---|
| 3243778 | 5/1984 | Germany . |
| 733242 | 1/1953 | United Kingdom . |

OTHER PUBLICATIONS

E.J. Justus et al., *Suction Roll Noise Reduction,* TAPPI, Dec. 1956, vol. 39, No. 12, pp. 851–857.

*Primary Examiner*—Steven Alvo
*Attorney, Agent, or Firm*—Ostrolenk, Faber, Gerb & Soffen, LLP

[57] ABSTRACT

A suction roll for a paper machine or the like including a perforated annular roll shell which is rotatable. A stationary suction box inside the roll shell with respect to which the shell rotates. The suction box is defined between two circumferentially spaced sealing ledges at the roll shell. A noise dampening chamber on the downstream side of the suction box defined by a further sealing ledge at the roll shell. A conduit communicating to the noise damping chamber to allow increased pressure in the chamber which reduces noise. At least one of a snifter valve, a suction blower, an air pump and a water pump communicating to the conduit for selectively adjusting the pressure in the noise damping chamber for damping roll noise.

16 Claims, 2 Drawing Sheets

SUCTION ROLL OF A PAPER MACHINE HAVING A NOISE DAMPING CHAMBER

BACKGROUND OF THE INVENTION

The present invention relates to a suction roll having an internal suction box with improved noise damping. Suction rolls are used preferably in paper manufacturing machines, particularly to assist in removing water from the wet web of paper or board. One problem which has been encountered for decades is the disagreeable production of noise by such suction rolls. Numerous measures for reducing the noise produced by suction rolls have been described. See, for instance, the TAPPI journal, December 1956, Vol. 39, No. 12, pages 851 to 857.

Furthermore, U.S. Pat. No. 2,857,823 discloses placing a sound damping chamber along the discharge or circumferential outlet side of the stationary suction box. The inside of the sound damping chamber is connected by relatively fine openings with the inner surface of the shell of the suction roll and with the rest of the inside of the suction roll.

Known measures for reducing noise generated by a suction roll may be effective to a greater or lesser extent with machine operating speeds that are not too high. However, in modern paper manufacturing machines, with operating speeds of between 1000 and 2000 m/min, sound reduction techniques are insufficient. Traditional devices for reducing noise do not prevent production of a disagreeable noise by suction rolls operating at higher speeds.

SUMMARY OF THE INVENTION

The object of the present invention is to develop a known suction roll with a clearly perceptible reduction in noise, even when operating at extremely high speeds, as compared with known rolls.

Another object is to provide a noise damping chamber in a suction roll which uses a pressure different than in the adjacent suction box and selected to reduce noise.

This object is achieved by providing a sealed damping chamber at the interior of the suction roll shell and past the downstream side of the suction box in the roll. The chamber is connectable to the surrounding area of or outside the suction roll which is at a higher pressure. For example, either a pressure supply or a suction source is connected to the chamber through a valve. The pressure supply or suction source connection may be through a snifter valve to the environment or may be to an air or water pump, or a blower, or the like.

Other objects and features of the invention are apparent from the following description of the invention shown in the accompanying drawings.

DETAILED DESCRIPTION OF THE INVENTION

Figure 1:
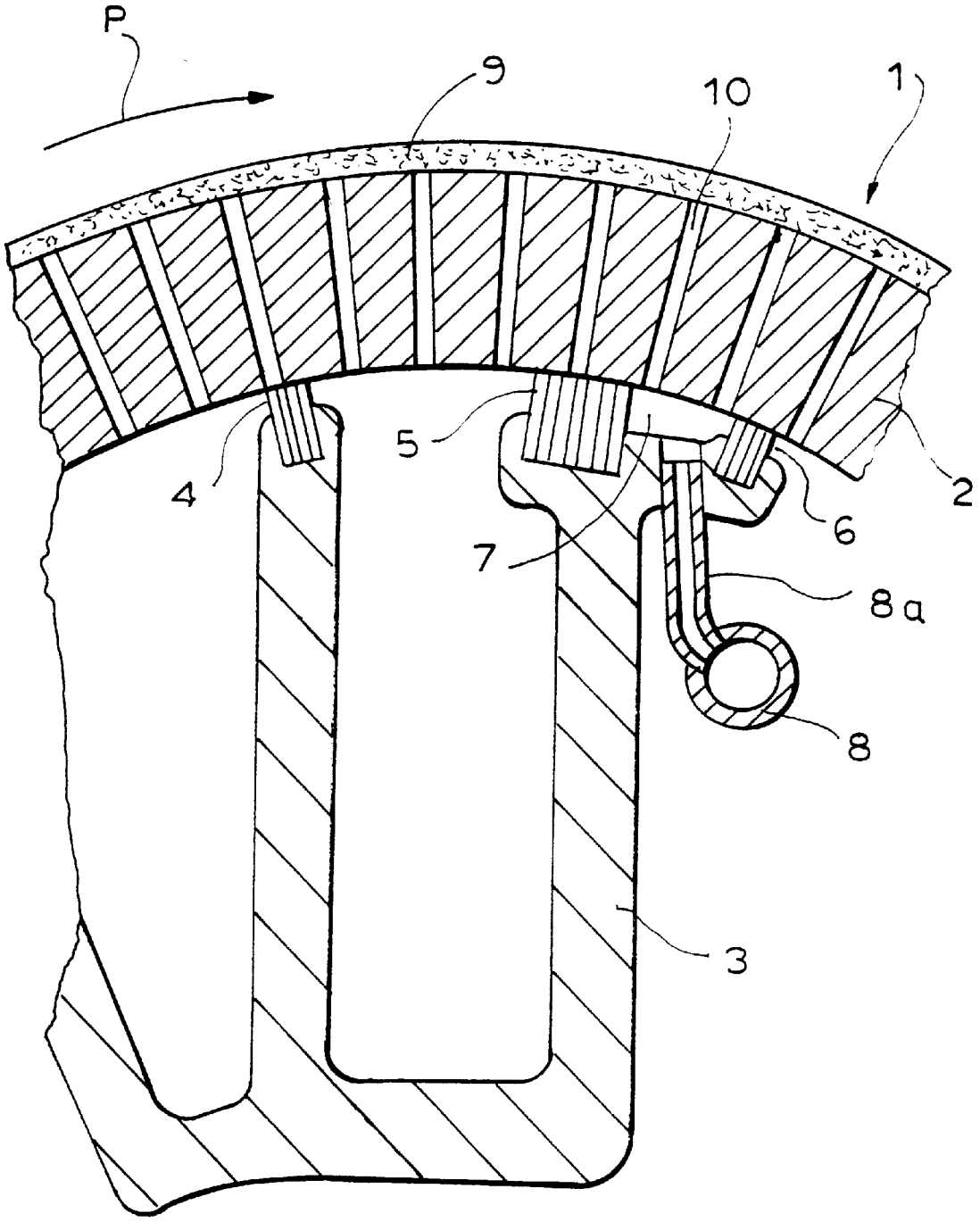
FIG. 1 is a cross-section through a fragment of a suction roll.

The invention may be used with an otherwise conventional suction roll, e.g. as in British Patent 733,242. FIG. 1 shows part of a suction roll 1, including a part of a revolving annular roll shell 2 which has radial perforations 10 passing through the shell. The direction of roll rotation is indicated by an arrow P. A paper web travels together with a wire or felt belt, both diagrammatically shown at 9, over the periphery of the rotating suction roll 1.

There is a stationary sealed chamber suction box 3 within the rotating suction roll shell 2. The reduced pressure in the suction box communicates with the inner surface of the roll shell 2 between the sealing ledges 4 and 5 spaced apart circumferentially around the shell. These sealing ledges define a suction zone of the suction box between them in the interior of the rotating roll shell. The circumferential length of the suction box between the ledges 4 and 5 is selected for the particular application for the roll, as in a suction press roll or a dryer section roll, etc. A further suction zone can be present in front of or upstream of the suction zone with respect to the direction of roll rotation. As is conventional, a conduit at the end of the roll brings vacuum into the suction box.

There is a noise damping chamber 7 behind or downstream of the suction zone defined by the sealing ledges 4 and 5 in the direction of rotation. The chamber 7 also communicates with the interior surface of the rotating roll shell. The chamber 7 is defined by the discharge side sealing ledge 5 of the suction box and by an additional sealing ledge 6 which is circumferentially spaced downstream from the ledge 5. The circumferential length of the suction zone at the roll shell between the ledges 4 and 5 is shown as longer than the circumferential length at the roll shell of the noise damping chamber between the ledges 5 and 6, although this is not required. Also, the volume of the chamber 7 is smaller, although this is not required. Reduced pressure in the suction box reduces the pressure in the perforations 10 beneath the felt belt 9. The rotating shell 2 "transports" the reduced pressure from the suction box to the chamber 7, which thereby reduces the pressure in the chamber 7. As shown in FIG. 1, the damping chamber (7) extends circumferentially along the shell a distance greater than the distance between circumferentially adjacent perforations (10) in the roll shell.

Figure 2:
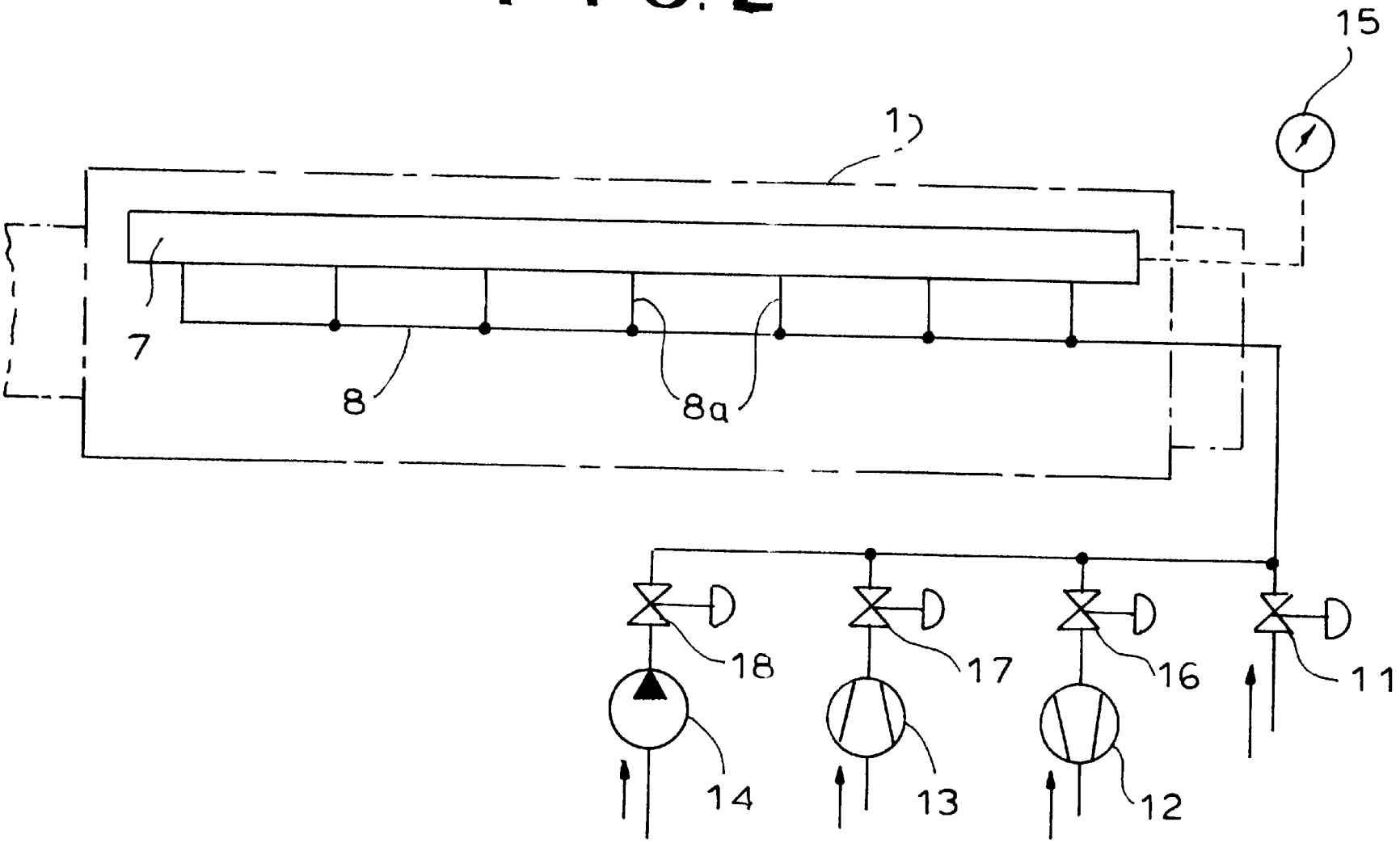
FIG. 2 is a schematic diagram of the conduits which are connected to the noise damping chamber of the suction roll.

FIG. 2 indicates the contour of the suction roll 1 diagrammatically with dashed lines and the contour of the noise damping chamber 7 with solid lines. A connecting conduit 8 extends substantially through the entire length of, i.e., across the interior of the suction roll. The conduit is connected by several transverse conduits 8*a* spaced at intervals along the length of the roll to the noise damping chamber 7. The connecting conduit 8 ends at some means by which the pressure within the chamber 7 can be selectively increased or decreased for achieving noise reduction. At a particular time or in a particular application, the pressure increase or decrease will achieve the noise reduction.

For instance, the conduit 8 may end at a controllable snifter valve 11. The snifter valve 11 can be opened to a greater or lesser extent when a vacuum is present in the noise damping chamber such that the noise caused by the rotation of the suction roll 1 is reduced by the shifting in of air.

As an alternative, the connecting conduit 8 can be optionally connected via a respective one of the controllable valves 16, 17 or 18 to a suction blower 12, to the delivery or an air pump 13 or a water pump 14. Elements 11, 13 or 14 can reduce the negative pressure in chamber 7, while element 12 may increase that pressure. The element is selected to provide the optimum reduction of noise from the suction roll 1. All of elements 11–14 may be present to enable selection of the optimum one for noise reduction. Testing on site for noise reduction is how one can select. These items are already usually present at a mill, so the appropriate one may be selected.

Depending on how high the operating speed is or the height of the vacuum necessary in the suction box 3 (or as a function of other parameters), merely one of the elements comprising the snifter valve 11, suction blower 12, air pump 13, and water pump 14 may be provided or more than one or all of them may be provided.

The increase or decrease in pressure caused by each of the elements 11–14 is indicated by the arrows in FIG. 2. The water pump increases the pressure (decreases the negative pressure) in the noise dampening chamber. It supplies some water to said chamber. This creates an air-water-mixture in the chamber and in the perforation 10, in order to reduce the noise.

A pressure measuring instrument 15 can be provided in order to note the pressure or vacuum prevailing in the noise damping chamber 7. Appropriate adjustment of the pressure/vacuum level in that chamber may be selected for optimum noise damping. The instrument allows the operator to return to or select a desired pressure.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A suction roll comprising:

a roll shell which is perforated, the roll shell being rotatable around an axis;

a stationary suction box disposed within the roll shell and the roll shell being rotatable with respect to the suction box; the suction box including circumferentially spaced apart sealing ledges, each ledge contacting the interior of the roll shell at a respective circumferentially spaced apart location around the roll shell and defining a suction zone in the suction box between the ledges at the roll shell; a first one of the ledges being at the circumferential discharge side of the suction box past which the roll shell rotates as it leaves the suction zone;

an additional sealing ledge spaced from the first ledge circumferentially around the roll shell and also contacting the interior of the roll shell;

means inside the roll shell defining a closed noise damping chamber sealed at the roll shell between the first ledge and the additional ledge, the noise damping chamber being disposed in a position that follows the suction zone with respect to the rotation path of the roll shell and extending circumferentially along the shell a distance greater than the distance between circumferentially adjacent perforations in the roll shell; and a connection from the noise damping chamber to means selectively allowing an increase or a decrease in pressure in the noise damping chamber, for causing reduction in the noise which is generated by the suction roll.

2. The suction roll of claim 1, wherein the suction roll includes an arcuate portion of its circumference on which a web to which suction is to be applied is wrapped; the suction box and the noise damping chamber being within the arcuate circumferential region wrapped by the web.

3. The suction roll of claim 2, wherein the means allowing an increase or a decrease of pressure in the noise damping chamber comprises means communicating with the area surrounding the suction roll.

4. The suction roll of claim 2, wherein the means allowing an increase or a decrease of pressure in the chamber comprises at least one connecting conduit communicating out of the suction chamber.

5. The suction roll of claim 4, further comprising a controllable snifter valve connected into the connecting conduit and also communicating to the surroundings of the suction roll.

6. The suction roll of claim 4, further comprising a suction blower connected into the connecting conduit and means connected with the suction blower for controlling the blowing by the suction blower into the connecting conduit.

7. The suction roll of claim 4, further comprising an air pump connected into the connecting conduit.

8. The suction roll of claim 4, further comprising a water pump connected into the connecting conduit decreasing pressure into the noise damping chamber.

9. The suction roll of claim 4, further comprising all of a snifter valve connected to the connecting conduit and communicating to the surroundings of the suction roll, a suction blower connected to the connecting conduit, an air pump connected to the connecting conduit, and a water pump connected to the connecting conduit; and means at each of the snifter valve, the suction blower, the air pump and the water pump for selectively connecting each to the connecting conduit for adjusting pressure in the connecting conduit and the noise damping chamber.

10. The suction roll of claim 4, further comprising a pressure measuring instrument connected to the noise damping chamber.

11. The suction roll of claim 2, wherein the suction box is shaped to have a relatively larger volume and the noise damping chamber is shaped to have a relatively smaller volume, and between the first and additional ledges, the noise damping chamber occupies a smaller arcuate length along the perforated shell than does the suction zone between the two ledges thereof.

12. The suction roll of claim 2, further comprising means for delivering suction to the suction box.

13. The suction roll of claim 2, wherein the perforations in the roll shell are so sized and placed that upon rotation of the roll shell, the reduced pressure is carried in the perforations from the suction box to the chamber.

14. The suction roll of claim 1, wherein the perforations in the roll shell are so sized and placed that upon rotation of the roll shell, the reduced pressure is carried in the perforations from the suction box to the chamber.

15. A suction roll comprising:

a substantially cylindrical, perforated roll shell having an interior and a circumference, the roll shell being rotatable around an axis;

a stationary suction box disposed within the roll shell, the roll shell being rotatable with respect to the suction box, the suction box including at least two circumferentially spaced apart sealing ledges, each ledge contacting the interior of the roll shell at a respective circumferentially spaced apart location around the roll shell and defining a suction zone in the suction box between the ledges at the roll shell, a first one of the ledges being disposed at a circumferential discharge side of the suction box past which the roll shell rotates as it leaves the suction zone;

a noise damping chamber disposed within the roll shell, the noise damping chamber having an opening in contact with the interior of the roll shell, the noise damping chamber being disposed in a position that follows the circumferential discharge side of the suction box with respect to the rotation path of the roll shell, and extending circumferentially along the shell a distance greater than the distance between circumferentially adjacent perforations in the roll shell, each circumferential location on the roll shell passing the noise damping chamber, as the roll shell rotates, after the location leaves the suction zone; and a connection from the noise damping chamber to an element selectively allowing an increase or a decrease in pressure in the noise damping chamber.

16. A suction roll comprising:

a perforated roll shell having an interior and a circumference, the roll shell being rotatable around an axis;

means for suction disposed within the roll shell, the roll shell being rotatable with respect to the means for suction, the means for suction including at least two circumferentially spaced apart means for sealing to the interior of the roll shell, each means for sealing contacting the interior of the roll shell at a respective circumferentially spaced apart location around the roll shell and defining a suction zone in the suction box between the means for sealing at the roll shell, a first one of the means for sealing being disposed at a circumferential discharge side of the suction zone, roll shell rotating past the first one of the means for sealing as the roll shell leaves the suction zone;

means for damping noise disposed within the roll shell, the means for damping noise comprising a chamber having an opening in contact with the interior of the roll shell, whereby the means for damping noise is disposed at a position that follows the means for suction with respect to the rotation path of the roll shell and extending circumferentially along the shell a distance greater than the distance between circumferentially adjacent perforations in the roll shell; and a connection from the means for damping noise to means for selectively allowing an increase or a decrease in pressure in the noise damping chamber, for causing reduction in the noise which is generated by the suction roll.

* * * * *